US006779349B2

(12) United States Patent
Yoshimura

(10) Patent No.: US 6,779,349 B2
(45) Date of Patent: Aug. 24, 2004

(54) STERLING REFRIGERATING SYSTEM AND COOLING DEVICE

(75) Inventor: Kazushi Yoshimura, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/362,187

(22) PCT Filed: Aug. 1, 2001

(86) PCT No.: PCT/JP01/06641

§ 371 (c)(1),
(2), (4) Date: Feb. 21, 2003

(87) PCT Pub. No.: WO02/16835

PCT Pub. Date: Feb. 28, 2002

(65) Prior Publication Data

US 2003/0172658 A1 Sep. 18, 2003

(30) Foreign Application Priority Data

Aug. 22, 2000 (JP) ..... 2000-250855

(51) Int. Cl.[7] ..... F25B 9/00
(52) U.S. Cl. ..... 62/6
(58) Field of Search ..... 62/6

(56) References Cited

FOREIGN PATENT DOCUMENTS

| | | | |
|---|---|---|---|
| JP | 1-155150 | A | 6/1989 |
| JP | 6-207757 | A | 7/1994 |
| JP | 7-180921 | A | 7/1995 |
| JP | 8-5179 | A | 1/1996 |
| JP | 8-94198 | A | 4/1996 |
| JP | 2000-18750 | A | 1/2000 |
| JP | 2000-146341 | A | 5/2000 |
| JP | 2000-205682 | A | 7/2000 |

*Primary Examiner*—Cheryl J. Tyler
*Assistant Examiner*—Malik N. Drake
(74) *Attorney, Agent, or Firm*—Birch, Stewart, Kolasch & Birch, LLP

(57) ABSTRACT

A ring-shaped jacket is fitted around the warm section of a Stirling refrigerating device, and a cylindrical heat-rejecting heat exchanger is disposed around the body of the Stirling refrigerating device with a gap secured in between. The jacket and the heat-rejecting heat exchanger are connected together with a pipe to form a closed circuit, and a refrigerant is circulated through the closed circuit. This allows the heat in the warm section to be transferred by the refrigerant, permitting efficient heat rejection from the heat-rejecting heat exchanger. Thus, the desired cold is obtained stably from the cold section of the Stirling refrigerating device.

11 Claims, 13 Drawing Sheets

STERLING REFRIGERATING SYSTEM AND COOLING DEVICE

This application is the national phase under 35 U.S.C. § 371 of PCT International Application No. PCT/JP01/06641 which has an International filing date of Aug. 1, 2001, which designated the United States of America.

BACKGROUND OF THE INVENTION

1. Field of the Invention

The present invention relates to a refrigerating system provided with a Stirling refrigerating device, and to a cooling apparatus such as a refrigerator employing such a refrigerating system.

2. Description of Related Art

In general, refrigerating cycle apparatuses such as household refrigerators adopt a vapor compression refrigerating cycle using a CFC (chlorofluorocarbon) as a refrigerant. As is well known, however, CFCs are notorious for their material contribution to the destruction of the ozone layer and, from the perspective of saving the environment, their use is increasingly restricted worldwide.

In recent years, as new refrigerating technology to replace the vapor compressing refrigerating cycle, much research has been done on Stirling refrigerating devices exploiting the reversed Stirling cycle. A Stirling refrigerating device uses an inert gas such as helium as a working medium, and therefore provides a cryogenic temperature efficiently without adversely affecting the global environment.

The reversed Stirling cycle is a closed cycle in which heat rejection and heat absorption are performed by repeatedly compressing and expanding a working medium together with a displacer driven to reciprocate with a predetermined phase difference kept relative to a piston inside a single cylinder by driving the cylinder with an external force fed from a linear motor or the like.

A Stirling refrigerating device requires a means for efficiently transferring the cold obtained in a low-temperature portion, called the cold section, thereof. Moreover, the higher the refrigeration performance of the Stirling refrigerating device, the larger the amount of heat generated in a heat-rejection portion, called the warm section, thereof, and therefore, unless the generated heat is efficiently rejected, the Stirling refrigerating device shows poor refrigeration performance, producing less cold than expected in its cold section.

For example, in the Stirling refrigerator disclosed in Japanese Patent Application Laid-Open No. H7-180921, as shown in FIG. 20, a cooler 101 for cooling the interior of the refrigerator is arranged in a highest, deepest position inside the body 100 of the refrigerator, and a Stirling refrigerating device 102 is housed inside a machine compartment at the bottom of the body. The cold section 103 of the Stirling refrigerating device 102 is connected to the cooler 101 by way of a pipe 104 filled with a working medium, and the working medium is circulated so that, when the Stirling refrigerating device 102 is operated, the cold generated in the cold section 103 is transferred by the working medium to the cooler 101 placed inside the refrigerator.

Then, the cold air obtained through heat exchange taking place on the surface of the cooler 101 between the cold transferred to the cooler 101 and the air inside the refrigerator is blown into the refrigerator interior by a fan 105, so that the refrigerator interior is cooled to a predetermined temperature. On the other hand, in the warm section 106 of the Stirling refrigerating device 102, heat-rejecting fins 107 are arranged, and air is blown therethrough by a blower fan 108 to prompt heat rejection from the warm section 106.

However, while refrigeration performance of the order of a few hundred watts is required in Stirling refrigerators for which high demands are expected as models for household and commercial use, attempting to achieve such refrigeration performance with the conventional construction described above results in extremely increasing the surface area of the heat-rejecting fins 107 and the amounts of cooling air blown by the blower fan 108.

This makes the refrigerating system as a whole larger, and thus makes it necessary to secure, for the machine compartment, a volume as large as or larger than in a conventional refrigerator of the vapor compression type. This not only makes it inevitable to reduce the volume of the remaining space inside the refrigerator, but also, as a result of increased electric power consumption by the fan, degrades the efficiency of the system as a whole, contrary to energy saving.

SUMMARY OF THE INVENTION

An object of the present invention is to provide a compact Stirling refrigerating system with enhanced refrigeration efficiency achieved by prompting heat rejection from the warm section.

To achieve the above object, according to one aspect of the present invention, a Stirling refrigerating system is provided with: a Stirling refrigerating device including a piston and a displacer that reciprocate with a predetermined phase difference kept therebetween inside a cylinder having a working medium sealed therein, a heat absorber that absorbs heat from outside to produce cold as a result of the working medium being expanded in an expansion space formed inside the cylinder as the displacer reciprocates, and a heat rejecter that rejects, to outside, heat generated as a result of the working medium being compressed in a compression space formed inside the cylinder as the piston reciprocates; a ring-shaped member fitted to the heat rejecter and having a refrigerant flow passage; a cylindrical heat-rejecting heat exchanger disposed around the Stirling refrigerating device with a gap secured in between and formed so as to have a refrigerant flow passage; a refrigerant circulation passage formed by connecting the refrigerant flow passage of the ring-shaped member and the refrigerant flow passage of the heat-rejecting heat exchanger with a pipe; and circulating means for circulating a refrigerant through the refrigerant circulation passage.

Specifically, the heat-rejecting heat exchanger is composed of a first header pipe having at one end thereof a connection port to which one end of the pipe is connected, a second header pipe laid next to the first header pipe and parallel, together with the first header pipe, to the axis of the Stirling refrigerating device and having at one end thereof a connection port to which the other end of the pipe is connected, a plurality of ring-shaped condenser pipes that connect the first and second header pipes together so that they communicate with each other therethrough, and fins fitted between the plurality of condenser pipes. In this construction, the refrigerant that has collected compression heat in the compression space flows through the pipe into the second header pipe, and then flows through the ring-shaped condenser pipes into the first header pipe. Meanwhile, the compression heat is transferred to the fins, and is efficiently rejected from the surfaces of the fins. In this case, the condenser pipes and the fins may be given substantially equal lengths in the radial directions of the Stirling refrigerating device. This helps increase the surface area of the fins that contributes to heat rejection.

On the other hand, the transferring means comprises a cylindrical rod slide portion formed at the end of the Stirling refrigerating device opposite to the heat absorber, a rod slidable together with the piston along the inner surface of the rod slide portion, a first magnet fitted at the tip end of the rod, a box member fitted at the tip end of the rod slide portion and forming part of the refrigerant circulation passage, a resonant spring placed inside the box member and having the rod slide portion placed therethrough, a second magnet slidable along the outer surface of the rod slide portion by the action of the resonant spring, and a movable member fixed to the second spring and capable of reciprocating along the outer surface of the rod slide portion and along the inner surface of the box member. The refrigerant that has flowed into the box member is discharged out of it by the pumping action of reciprocating movement of the movable member.

In this construction, as the piston reciprocates, the first magnet fitted at the tip end of the rod reciprocates together, and, by the magnetism it exerts, the second magnet also reciprocates along the outer surface of the rod slide portion. Thus, the refrigerant that flows into the box member is discharged out of it by the doughnut-shaped member. This eliminates the need to use as a transferring means an external force as provided by a circulating pump or the like, and thus helps save energy.

A blower fan that blows air through the space inside the heat-rejecting heat exchanger may be provided. The air blown by the blower fan then prompts heat rejection from the surfaces of the fins of the heat-rejecting heat exchanger.

In this case, the fins may be so formed as to protrude outward from the outer profile of the condenser pipes in the radial directions. This increases, on the downstream side of the blown air, the surface area of the fins that contributes to heat rejection, and thus helps further prompt heat rejection from the fins by the blown air.

Another example of the heat-rejecting heat exchanger comprises a first header pipe having at both ends thereof connection ports that are connected to the pipe and having an internal space thereof partitioned off in a length direction thereof, a second header pipe laid next to the first header pipe and parallel, together with the first header pipe, to the axis of the Stirling refrigerating device, a plurality of ring-shaped condenser pipes that connect the first and second header pipes together so that they communicate with each other therethrough, and fins fitted between the plurality of condenser pipes.

In this construction, the refrigerant that has collected compression heat in the compression space flows through the pipe into the first header pipe, and then flows through the ring-shaped condenser pipes located on the upstream side of the partition plate into the second header pipe. Moreover, the refrigerant filling the second header pipe flows through the ring-shaped condenser pipes located on the downstream side of the partition plate back into the first header pipe. Meanwhile, the compression heat is transferred to the fins, and is efficiently rejected from the surfaces of the fins.

To achieve the above object, according to another aspect of the present invention, a Stirling refrigerating system is provided with: a Stirling refrigerating device including a piston and a displacer that reciprocate with a predetermined phase difference kept therebetween inside a cylinder having a working medium sealed therein, a heat absorber that absorbs heat from outside to produce cold as a result of the working medium being expanded in an expansion space formed inside the cylinder as the displacer reciprocates, and a heat rejecter formed as a ring-shaped refrigerant flow passage that rejects, to a refrigerant, heat generated as a result of the working medium being compressed in a compression space formed inside the cylinder as the piston reciprocates; a heat-rejecting heat exchanger disposed around the Stirling refrigerating device with a gap secured in between and formed so as to have a refrigerant flow passage; a refrigerant circulation passage formed by connecting the refrigerant flow passage of the heat rejecter and the refrigerant flow passage of the heat-rejecting heat exchanger with a pipe; and circulating means for circulating a refrigerant through the refrigerant circulation passage.

In a cooling apparatus having a Stirling refrigerating system as described above housed inside a machine compartment formed at the bottom of the body of the cooling apparatus, the interior of the body, enclosed with a heat-insulating material, is cooled by exploiting cold generated in the heat absorber as the Stirling refrigerating device is operated.

DETAILED DESCRIPTION OF THE INVENTION

Hereinafter, embodiments of the present invention will be described with reference to the drawings.

Figure 1:
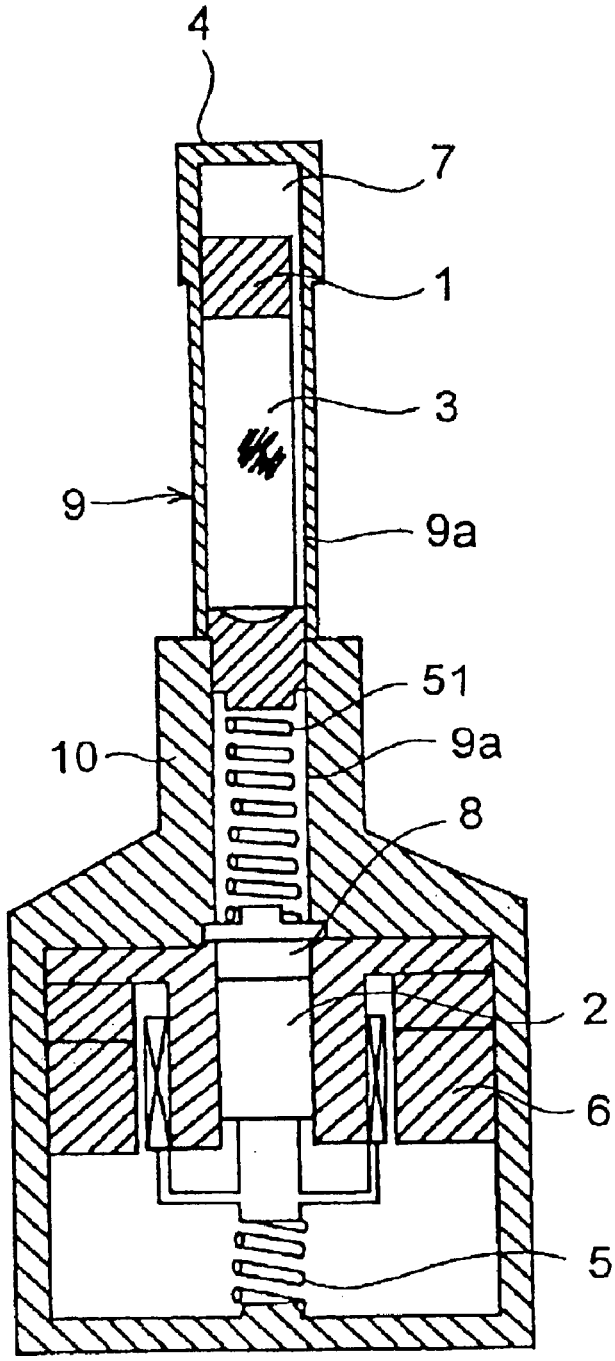
FIG. 1 is a sectional view of an example of a free-piston-type Stirling refrigerating device.

A first embodiment of the invention will be described below with reference to the drawings. FIG. 1 is a sectional view of a free-piston-type Stirling refrigerating device. First, how this refrigerating device operates will be described.

A piston 2 is driven by a linear motor 6, and moves sinusoidally by the action of a resonant spring 5. As the piston 2 reciprocates, working gas in a compression space 8 exhibits sinusoidal pressure fluctuation. This pressure fluctuation of the working gas is converted into a force that drives a displacer 1 provided inside a cylinder 9*a* to move axially. Thus, the displacer 1, by the action of a resonant spring 51 moves sinusoidally with a predetermined phase difference (for example, 90°) kept relative to the piston 2.

The working gas, compressed in the compression space 8, rejects compression heat in a warm section (heat rejector) 10, and the working gas is then precooled by a regenerator 3 provided inside the displacer 1, and then flows into an expansion space 7. On the other hand, the working gas in the expansion space 7 is expanded by the movement of the displacer 1, and absorbs heat from outside through a cold section (heat absorber) 4 provided at the tip end of a Stirling refrigerating device body 9. Thus, cryogenic cold is obtained in this cold section 4.

Figure 2:
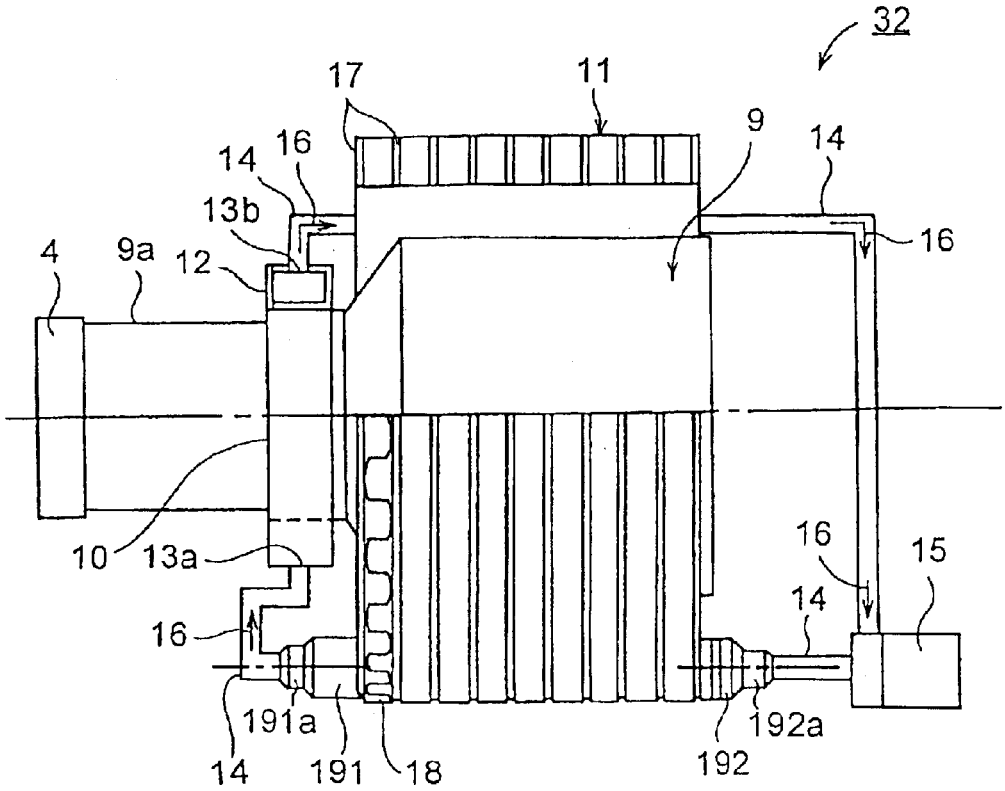
FIG. 2 is a partially cutaway side view showing an outline of the construction of the Stirling refrigerating system of a first embodiment of the invention.

FIG. 2 is a sectional view showing an outline of the configuration of the Stirling refrigerating system 32 of this embodiment. FIG. 2 shows a case in which the Stirling refrigerating device body 9 is disposed horizontally with the cold section 4 at the left. Around a cylindrical portion of the Stirling refrigerating device body 9 from about the right-hand end thereof to about the right-hand end of the warm section 10, there is provided a cylindrical heat-rejecting heat exchanger 11 with a gap secured from the circumference of the Stirling refrigerating device body 9. In the figure, for easy understanding of the construction of the heat-rejecting heat exchanger 11, the upper half thereof, located above the Stirling refrigerating device body 9, is partially cut away.

Figure 3:
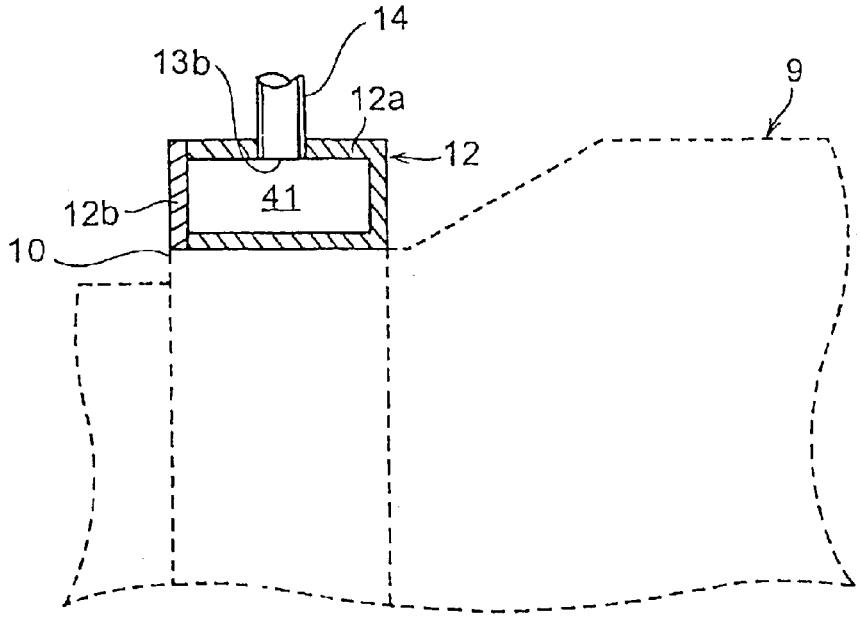
FIG. 3 is an enlarged sectional view showing the structure of the jacket of the Stirling refrigerating system.

Around the warm section 10 is fitted a ring-shaped jacket 12. The jacket 12 is ring-shaped, and has a doughnut-shaped space 41 formed inside. As shown in FIG. 3, the jacket 12 is composed of a C-shaped ring 12*a* and a flat plate 12*b* that hermetically closes the open side of the ring 12*a*. In two opposite places on the jacket 12 across the center thereof, there are provided a first and a second connection port 13*a* and 13*b* to which pipes 14 are connected.

Figure 4A:
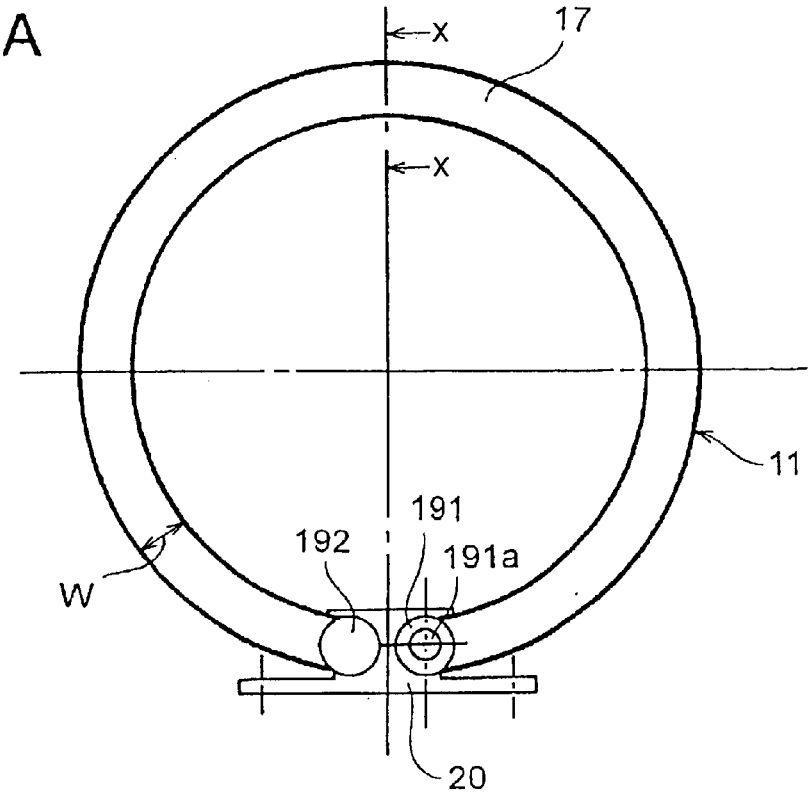
FIG. 4A is a top view showing the construction of the heat-rejecting heat exchanger of the Stirling refrigerating system.
Figure 4B:
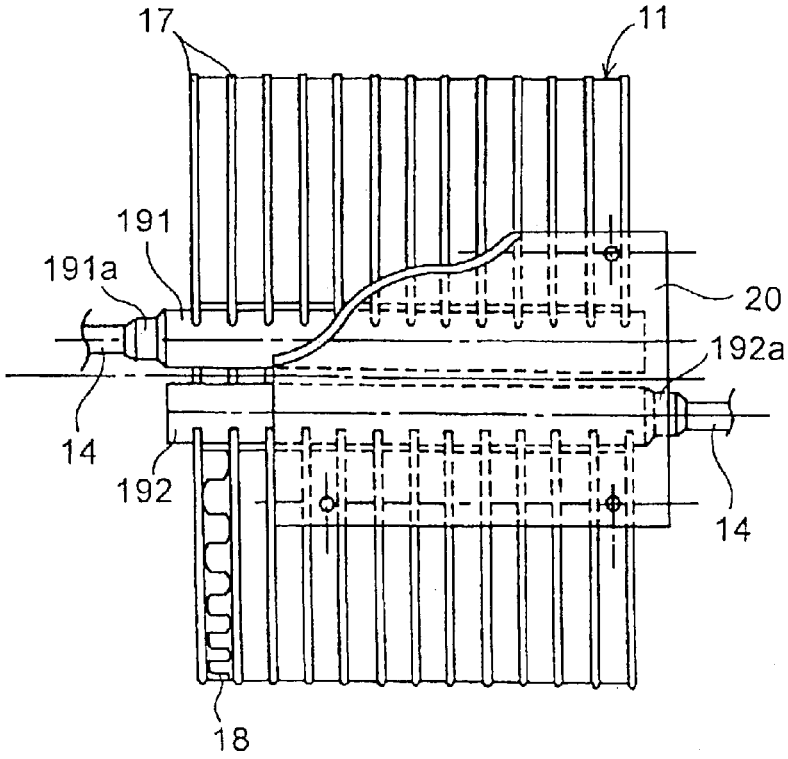
FIG. 4B is a side view showing the construction of the heat-rejecting heat exchanger of the Stirling refrigerating system.

As shown in a top view and a side view in FIGS. 4A and 4B, the heat-rejecting heat exchanger 11 is composed of a first header pipe 191 and a second header pipe 192 arranged next to each other and parallel to the axis of the Stirling refrigerating device body 9 with their connection ports 191*a* and 192*a* pointing in opposite directions, a plurality of ring-shaped condenser pipes 17 that connect the first and second header pipes 191 and 192 together at predetermined intervals so that they communicate with each other, and corrugated fins 18 fitted between the condenser pipes 17.

Now, the procedure for producing the heat-rejecting heat exchanger 11 will be described. First, the first and second header pipes 191 and 192 are arranged on a plane, parallel to but away from each other. Then, the plurality of condenser pipes 17 are fitted into the first and second header pipes 191 and 192 in places thereon facing each other, and are held with a jig to maintain a predetermined shape. Then, the fins 18 are fitted between the condenser pipes 17 to produce a flat prototype of the heat-rejecting heat exchanger 11. Then, the heat-rejecting heat exchanger 11 is heated inside a blast furnace set at about 620° C. so that its components are welded together where they fit into or make contact with one another. Then, the heat-rejecting heat exchanger 11 is taken out of the blast furnace and cooled, and then the condenser pipes 17 are bent along the circumferential surface of a cylindrical jig so that the heat-rejecting heat exchanger 11 is formed into a ring-like shape with the first and second header pipes 191 and 192 placed next to each other. Then, the connection ports 191*a* and 192*a* are fitted respectively at one end of each of the first and second header pipes 191 and 192. Lastly, the first and second header pipes 191 and 192 are fixed to each other with a spacer 20, made of a material with low thermal conductivity, such as a resin, interposed in between to complete the heat-rejecting heat exchanger 11, now cylindrical.

One role of the spacer 20 is to maintain the ring-like shape by acting against the force exerted by the condenser pipes 17, which have been bent along the jig, to restore their original shape. Another role of the spacer 20 is to separate the first and second header pipes 191 and 192 from each other with a material with low thermal conductivity so that no heat exchange takes place as the refrigerant enters the second header pipe 192, circulates through the condenser pipes 17, and exits from the first header pipe 191. The spacer 20 also serves as a fitting leg that is fixed to the bottom surface of the machine compartment or the like of the refrigerator. The first and second header pipes 191 and 192 themselves do not make direct contact with the fins 18, and thus form a dead space that contributes little to heat exchange. However, by arranging the heat-rejecting heat exchanger 11 with the first and second header pipes 191 and 192 down, it is possible to permit the fins 18 to face a wide space and thereby enhance heat exchange efficiency.

Figure 5:
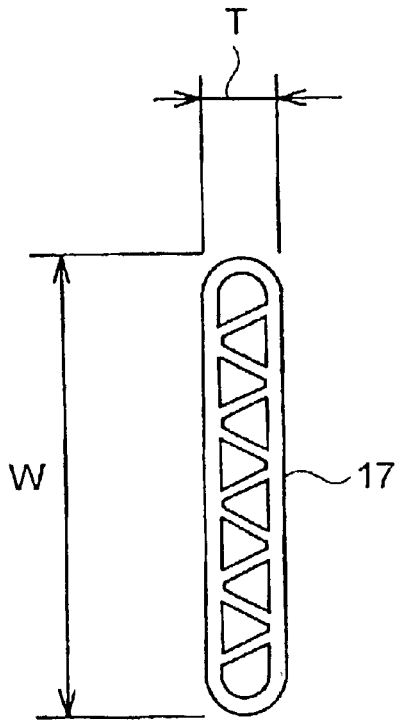
FIG. 5 is a sectional view of the condenser pipes of the heat-rejecting heat exchanger.

FIG. 5 shows the sectional structure of the condenser pipes 17, taken along line x—x shown in FIG. 4A. As shown in FIG. 5, the condenser pipes 17 are flat pipes each having multiple channels, and have their interior formed into a triangular truss structure with reinforcement ribs. These condenser pipes 17 are easily formed by extrusion molding of aluminum. In FIG. 5, W represents the length of the condenser pipes 17 in the radial directions of the Stirling refrigerating device body 9, and T represents their thickness.

Figure 6:
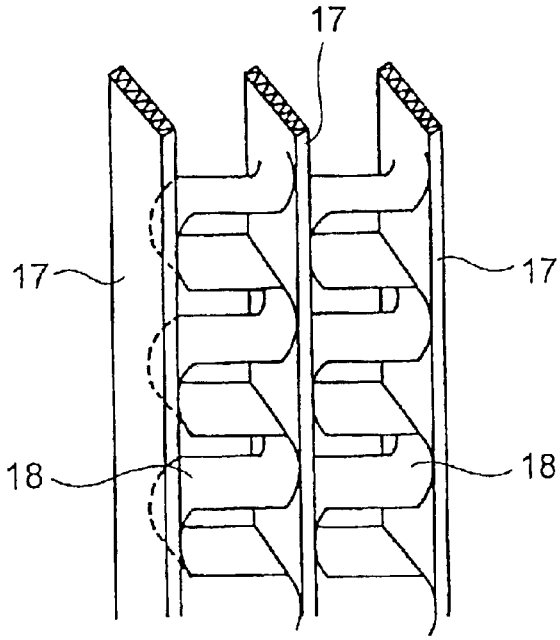
FIG. 6 is a diagram schematically showing the structure of a principal portion of the heat-rejecting heat exchanger.

As shown in FIG. 6, the fins 18 fitted between the condenser pipes 17 are each formed by bending thin aluminum foil at regular intervals into a corrugated shape, and are arranged parallel to one another to form a ring-like shape. The condenser pipes 17 and the fins 18 are given substantially equal lengths in the radial directions of the Stirling refrigerating device body 9.

Moreover, as shown in FIG. 2, pipes 14 are connected between the connection port 191*a* of the first header pipe 191 and the first connection port 13*a* of the jacket 12, between the second connection port 13*b* of the jacket 12 and a circulation pump 15, and between the circulation pump 15 and the connection port 192*a* of the second header pipe 192 to form a closed circuit. In this closed circuit is sealed a fluid, such as ethyl alcohol, as a refrigerant 16. As the circulation pump 15 is operated, the refrigerant 16 is circulated in the direction indicated by arrows.

In FIG. 2, when the circulation pump 15 is operated, the compression heat generated in the warm section 10 of the Stirling refrigerating device body 9 conducts through the jacket 12 to the refrigerant 16, and is then transferred through the pipes 14 to the heat-rejecting heat exchanger 11. As the refrigerant 16 passes through the condenser pipes 17, the heat is rejected from the surfaces of the fins 18 to outside.

In this embodiment, the jacket 12 is formed as a combination of a C-shaped ring 12*a* and a flat plate 12*b*. Instead, a flattened tube may be wound around the warm section 10.

Figure 7:
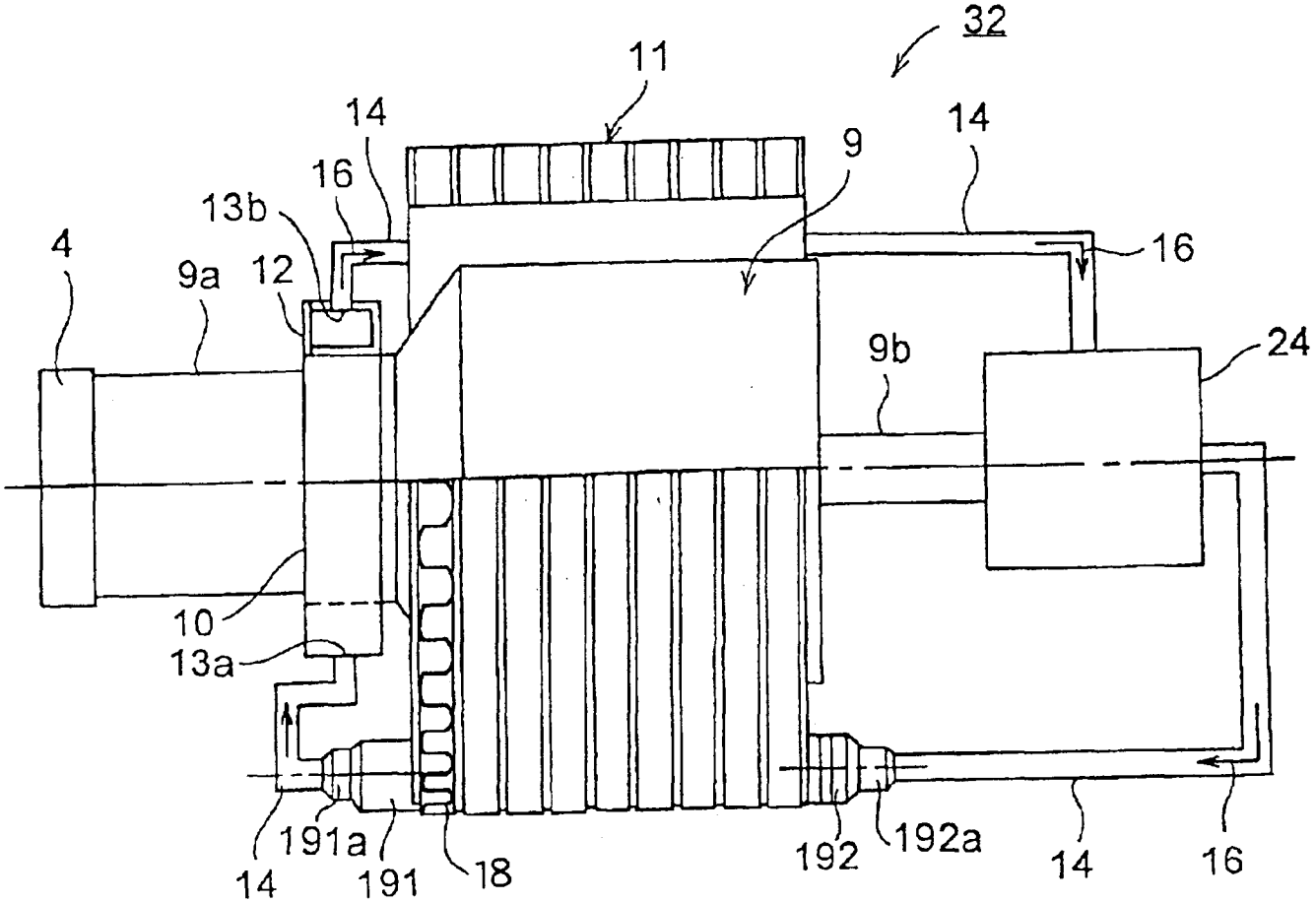
FIG. 7 is a partially cutaway external view showing an outline of the construction of the Stirling refrigerating system of a second embodiment of the invention.
Figure 8:
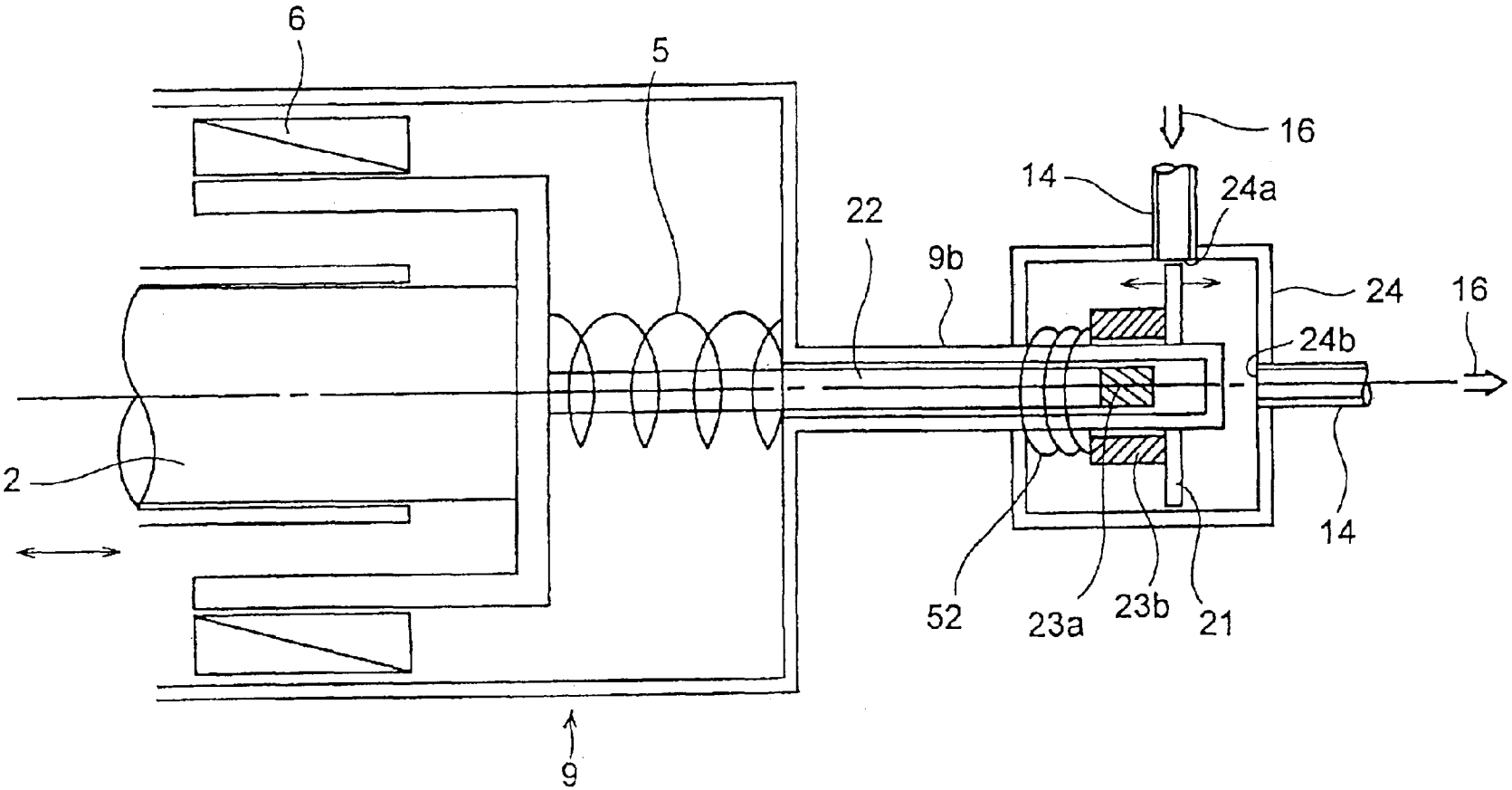
FIG. 8 is an enlarged section view showing a portion of the Stirling refrigerating system.

A second embodiment of the invention will be described below with reference to the drawings. FIG. 7 is a partially cut-away external view showing an outline of the configuration of the Stirling refrigerating system of this embodiment, and FIG. 8 is an enlarged sectional view of a portion of the Stirling refrigerating system. In these figures, such components as are common to the first embodiment shown in FIG. 2 and described above are identified with the same reference numerals, and their detailed explanations will not be repeated.

The present embodiment will be described with reference to FIGS. 7 and 8. At the right-hand end of the Stirling refrigerating device body 9, i.e., at the end thereof opposite to the cold section 4, there is disposed a cylindrical rod slide portion 9*b*. Into the space inside this rod slide portion 9*b* is inserted a rod 22 that can slide axially along the inner surface thereof. One end of the rod 22 is fixed to the center of the piston 2 in the axial direction thereof, and the other end of the rod 22 is fitted with a first magnet 23*a*.

At the tip end of the rod slide portion 9*b* is fitted a cylindrical box member 24. Inside the box member 24, there are provided a resonant spring 52 through which the rod slide portion 9*b* is placed, a second magnet 23*b* that can slide along the outer surface of the rod slide portion 9*b*, and a doughnut-shaped member 21 that is fixed to the second magnet 23*b* and that can slide along the outer surface of the rod slide portion 9*b* and along the inner surface of the box member 24. The second magnet 23*b* is fixed to the inner surface of the box member 24 by the resonant spring 52. In an upper portion of the circumferential surface of the box member 24, and in the right-hand end surface thereof, a first and a second connection ports 24*a* and 24*b* are respectively formed.

Moreover, pipes 14 are connected between the connection port 191*a* of the first header pipe 191 and the first connection port 13*a* of the jacket 12, between the second connection port 13*b* of the jacket 12 and the first connection port 24*a* of the box member 24, and between the second connection port 24*b* of the box member 24 and the connection port 192*a* of the second header pipe 192 to form a closed circuit.

In FIG. 8, when the linear motor 6 is operated, the piston 2 reciprocates, and the rod 22, together with the first magnet 23*a*, reciprocates with the same period as the piston 2. Simultaneously, the second magnet 23*b* starts reciprocating so as to be resonant with the first magnet 23*a*. That is, as the first magnet 23*a* moves rightward, the second magnet 23*b* moves rightward by the action of their magnetism attracting each other. Similarly, as the first magnet 23*a* moves leftward, the second magnet 23*b* moves leftward. The resonance amplitude of the second magnet 23*b* is set about equal to that of the first magnet 23*a* by the resonant spring 52. Together with the second magnet 23*b*, the doughnut-shaped member 21 reciprocates leftward and rightward. As a result, as indicated by arrows in FIG. 8, the refrigerant 16 that has brought into the box member 24 by a pumping mechanism is driven out of it to circulate through the closed circuit connected by the pipes 14.

The linear motor 6 is generally operated at the frequency of commercially distributed electric power (50 or 60 Hz). Accordingly, the piston 2 reciprocates at that frequency, and the doughnut-shaped member 21 inside the box member 24 reciprocates at the same frequency. This permits the refrigerant 16 to be transferred with satisfactory performance. In a case where the Stirling refrigerating device is of a crank type, the rotational movement of the motor that drives the piston and the displacer may be exploited to rotate an impeller provided inside the box member and thereby achieve a similar pumping mechanism.

Figure 9:
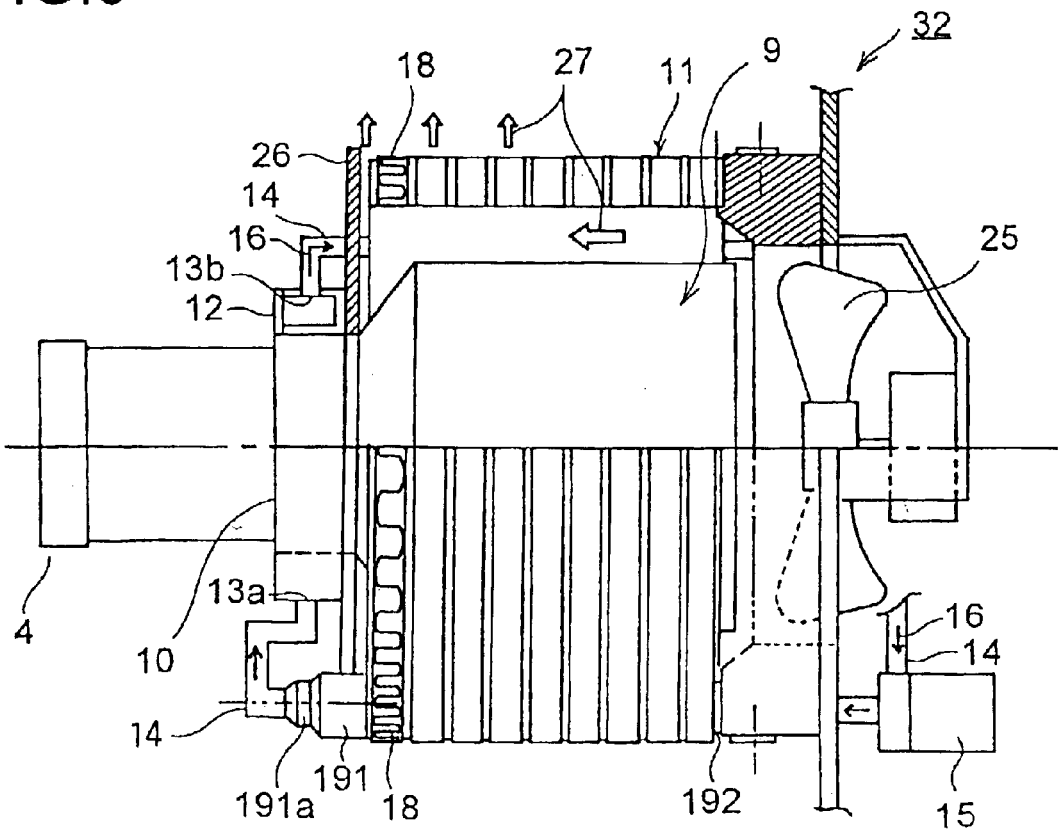
FIG. 9 is a partially cutaway side view showing an outline of the construction of the Stirling refrigerating system of a third embodiment of the invention.

A third embodiment of the invention will be described below with reference to the drawings. FIG. 9 is a partially cut-away side view showing an outline of the construction of the Stirling refrigerating system of this embodiment. In this figure, such components as are comment to the first embodiment shown in FIG. 2 and described earlier are identified with the same reference numerals, and their detailed explanations will not be repeated.

The present embodiment will be described with reference to FIG. 9. On the right-hand side of the heat-rejecting heat exchanger 11, i.e., on the side opposite to the cold section 4, there is disposed a blower fan 25 that can rotate about the axis of the Stirling refrigerating device body 9. On the other hand, on the right-hand side of the heat-rejecting heat exchanger 11, a ring-shaped shielding plate 26 is fitted around the warm section 10, next to the jacket 12. The shielding plate 26 has a diameter at least greater than that of the heat-rejecting heat exchanger 11, and serves to shield the air 27 blown into the heat-rejecting exchanger 11 as the blower fan 25 rotates so that it does not leak to the warm section 10.

Figure 10:
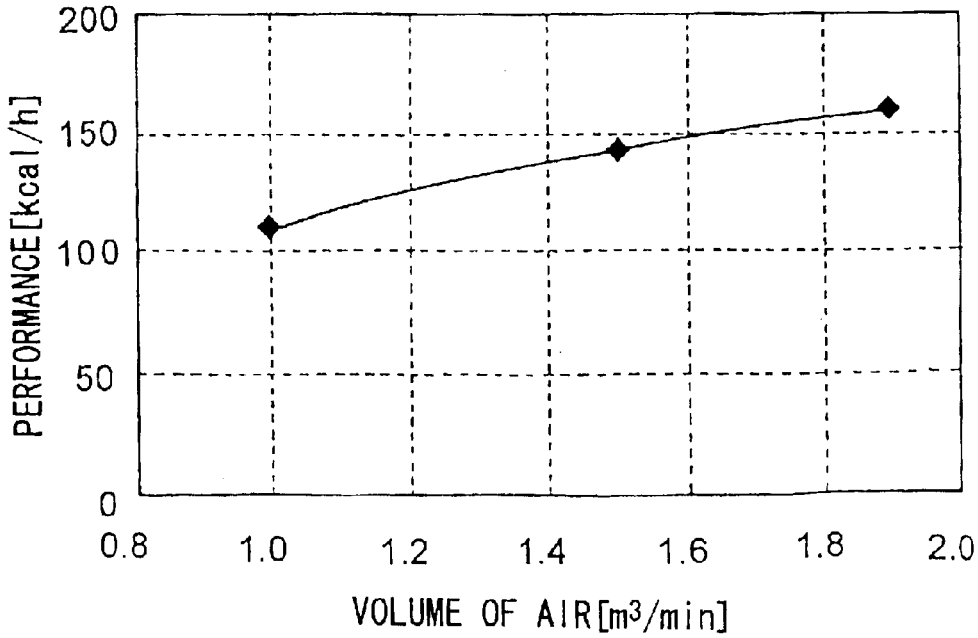
FIG. 10 is a graph showing the relationship between the volume of air blown by the lower fan and the heat exchange performance of the heat-rejecting heat exchanger in the Stirling refrigerating system.

The air 27 blown as the blower fan 25 rotates flows inside the heat-rejecting heat exchanger 11 along the Stirling refrigerating device body 9, is then shielded by the shielding plate 26, and then passes between the fins 18 so as to be discharged out of the heat-rejecting heat exchanger 11. This prompts heat rejection by the heat-rejecting heat exchanger 11. In this case, as shown in FIG. 10, the heat exchange performance of the heat-rejecting heat exchanger 11 can be controlled by increasing or decreasing the volume of air blown by the blower fan 25.

As described earlier, the Stirling refrigerating device is a device in which the piston 2 is driven by the linear motor 6 to produce a cold temperature in the cold section 4. This means that, by varying the rms value of the alternating-current voltage applied to the linear motor 6, it is possible to vary the amplitude of the reciprocating movement of the piston 2. En fact, as the rms value of the alternating-current voltage applied to the linear motor 6 is increased as time passes, the amplitude of the piston 2 increases accordingly, and the pressure of the working gas compressed in the compression space 8 gradually increases. As a result, the amount of heat absorbed when the working gas is expanded by the displacer 1 in the expansion space 7 increases. This permits a lower temperature to be produced in the cold section 4.

However, as the pressure of the working gas in the compression space 8 increases, the compression heat generated in the warm section 10 increases. Thus, unless the increased compression heat is efficiently rejected, the refrigeration performance of the Stirling lowers, and the temperature of the cold section 4 rises.

When the Stirling refrigerating device is being operated at an extremely low output, it is sufficient to operate the circulation pump 15 alone without rotating the blower fan 25 so that the heat in the warm section 10 is transferred to the heat-rejecting heat exchanger 11 by the refrigerant 16 and rejected naturally. However, as the output of the Stirling refrigerating device increases, the blower fan 25 needs to be energized to increase the heat exchange performance of the heat-rejecting heat exchanger 11.

As described above, the refrigeration performance of the Stirling refrigerating device is largely proportional to the rms value of the alternating-current voltage applied to the linear motor 6. Therefore, the input to the blower fan 25 is controlled according to the input to the linear motor 6. Specifically, when the input to the linear motor 6 is increased, the input to the blower fan 25 is increased and, when the input to the linear motor 6 is decreased, the input to the blower fan 25 is decreased. In particular, when the Stirling refrigerating device is operated at its maximum output, the input to the circulation pump 15 is increased to increase the circulation of the refrigerant and the input to the blower fan 25 is increased to increase the volume of blown air to maximize rejection of the compression heat generated in the warm section 10.

In this embodiment, the air 27 blown as the blower fan 25 rotates flows inside the heat-rejecting heat exchanger 11 along the Stirling refrigerating device body 9, and then passes between the fins 18 so as to be discharged to outside. However, the same effect is achieved by passing air in the reverse direction, specifically by sucking air in from outside the heat-rejecting heat exchanger 11 and then passing it along the Stirling refrigerating device body 9 so as to discharge it to behind the blower fan 25.

Figure 11:
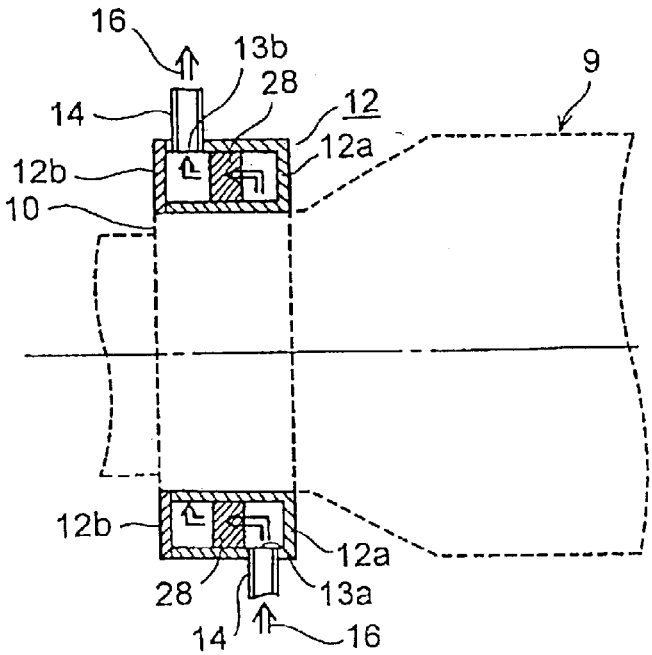
FIG. 11 is a sectional view showing the structure of the jacket of the Stirling refrigerating system of a fourth embodiment of the invention.

A fourth embodiment of the invention will be described below with reference to the drawings. FIG. 11 is a sectional view showing the structure of the jacket of the Stirling refrigerating system of this embodiment. The present embodiment is that, as shown in FIG. 11, inside the jacket 12 fitted around the warm section 10, fins 28 are arranged in a ring-like shape. These fins 28, like the fins 18 of the heat-rejecting heat exchanger 11, are corrugated by bending thin copper foil at regular intervals by the use of a gear.

The fins 28 are welded to the interior of the jacket 12 all around the space inside it so that their bent portions are kept in contact with the inner and outer walls of the interior of the jacket 12. The first and second connection ports 13*a* and 13*b* of the jacket 12 are provided in the flow path of the refrigerant so as to face each other on the upstream and downstream sides of the fins 28. This permits the refrigerant 16 passing inside the jacket 12 to make contact with a wide area on the surfaces of the fins 28.

Next, the flow of the refrigerant will be described with reference to FIG. 11. As the circulation pump 15 (see FIG. 2) is operated, the refrigerant 16 flows through the pipe 14 into the jacket 12 via the first connection port 13*a*. The refrigerant 16 inside the jacket 12 fills, owing to the pressure loss through the fins 28, the upstream side (right-hand side) portion thereof, and then passes through the fins 28 to move to the downstream side (left-hand side) portion thereof. Thereafter, the refrigerant 16 exits via the second connection port 13*b* and is transferred through the pipe 14 to the heat-rejecting heat exchanger 11 (see FIG. 2). This permits the heat of the warm section 10 to be transferred effectively to the refrigerant 16 and thus helps enhance heat exchange efficiency.

Incidentally, narrowing the pitch of the fins 18 (see FIG. 6) of the heat-rejecting heat exchanger 11 is considered to increase the surface area that contributes to heat exchange and thus increase the heat exchange performance of the heat-rejecting heat exchanger 11.

In common household refrigerators, a mechanical component such as a Stirling refrigerating device is housed in a machine compartment located at the bottom of the body. The machine compartment is usually so designed that outside air is allowed in for heat rejection. Therefore, the heat-rejecting heat exchanger 11, when the pitch of the fins 18 is narrowed, tends to suffer from dust contained in outside air collecting between the fins 18, eventually resulting in lower heat exchange efficiency. This being the case, how to enhance heat exchange performance without unduly reducing the pitch of the fins 18 will be described below.

Figure 12:
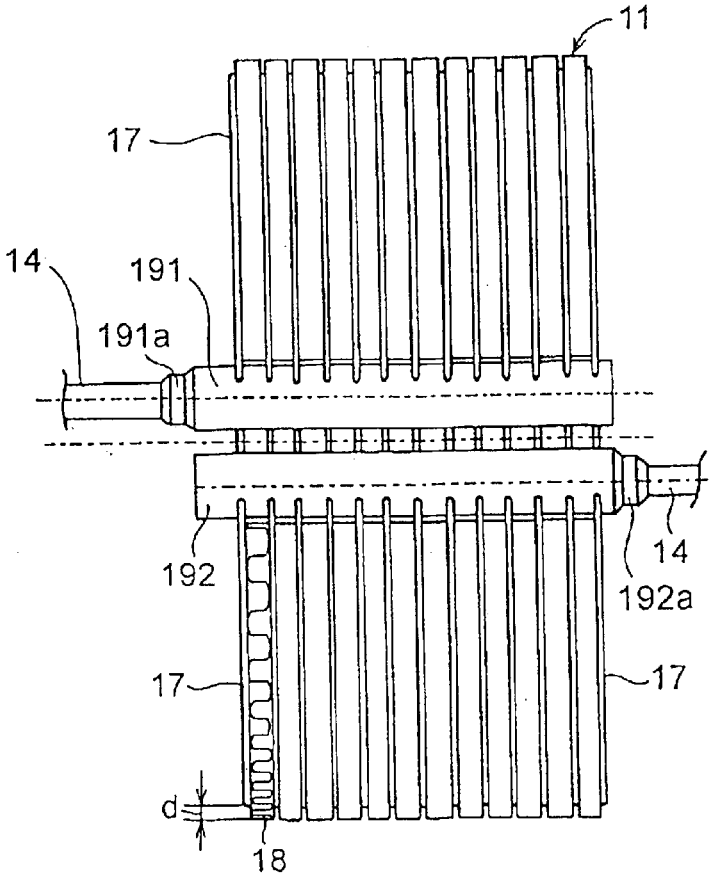
FIG. 12 is a side view showing the construction of the heat-rejecting heat exchanger of the Stirling refrigerating system of a fifth embodiment of the invention.

A fifth embodiment of the invention will be described below with reference to the drawings. FIG. 12 is a side view showing the configuration of the heat-rejecting heat exchanger of the Stirling refrigerating system of the fifth embodiment of the invention, and FIG. 13 is an enlarged sectional view showing a portion of the heat-rejecting heat exchanger.

Figure 13:
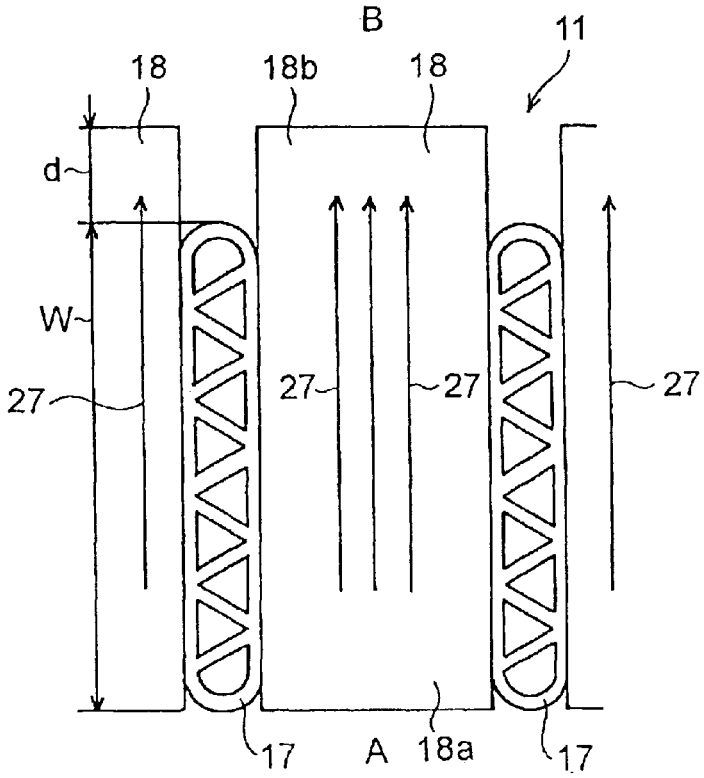
FIG. 13 is an enlarged sectional view of a portion of the heat-rejecting heat exchanger.

In this embodiment, as shown in FIGS. 12 and 13, the fins 18 are extended so as to protrude outward, by a distance of d, from the outer profile of the condenser pipes 17 in the radial directions of the Stirling refrigerating device body 9. Accordingly, the length of the fins 18 (hereinafter "the width of the fins 18") in the radial directions of the Stirling refrigerating device body 9 equals W+d.

As shown in FIG. 13, the air 27 blown as the blower fan 25 (see FIG. 9) rotates passes between the fins 18 and is discharged from the space A inside the heat-rejecting heat exchanger 11 to the space B outside thereof. There is a slight temperature slope of the surfaces of the fins 18. Specifically, the temperature in entrance portions 18*a* thereof where the flow speed is unstable is lower than in exit portions 18*b* thereof where the flow of air 27 is substantially uniform. Therefore, the exit portions 18*b* contribute more to heat exchange performance.

Figure 14:
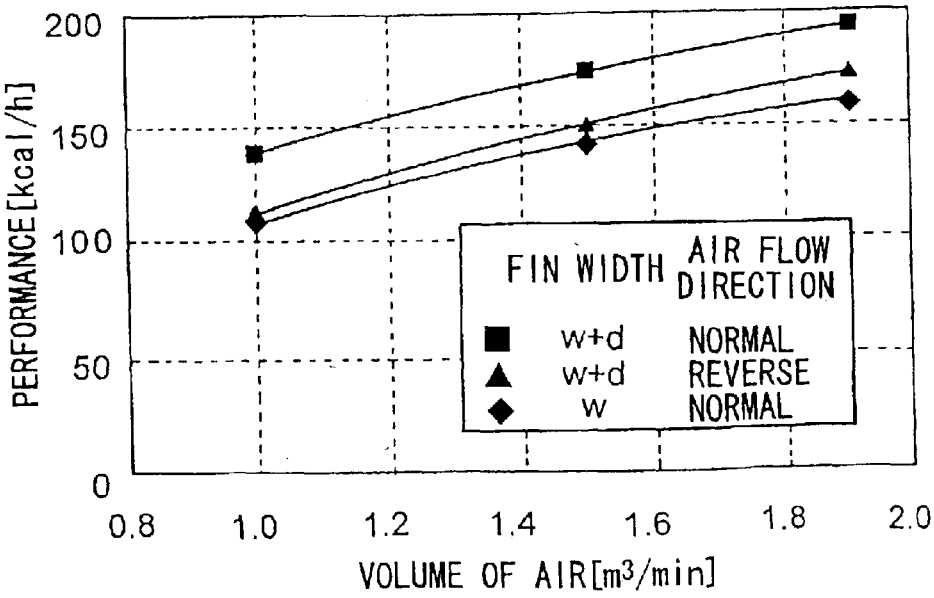
FIG. 14 is a graph showing the relationship between the volume of air blown by the lower fan and the heat exchange performance of the heat-rejecting heat exchanger in the Stirling refrigerating system, with varying fin widths.

FIG. 14 shows an example of the relationship between the width of the fins 18 and the heat exchange performance of the heat-rejecting heat exchanger, with the symbol ♦ indicating a case where the fins 18 have a width of W and the air 27 flows in the normal direction (from A to B in FIG. 13), the symbol ▲ indicating a case where the fins 18 have a width of W+d and the air flows in the opposite direction (from B to A in FIG. 13), and the symbol ■ indicating a case where the fins 18 have a width of W+d and the air flows in the normal direction. With the air 27 flowing in the normal direction, by extending the fins 18, it was possible to enhance heat exchange performance by about 20%. It was also confirmed that, even with the air 27 flowing in the reverse direction, heat exchange performance increased modestly by about 8%.

Another way to enhance the heat exchange performance of the heat-rejecting heat exchanger 11 is to increase the number of condenser pipes 17 and increase the number of fins 18 fitted between the condenser pipes 17 so as to increase the surface area that contributes to heat exchange.

However, when the number of condenser pipes 17 is increased, the more condenser pipes 17 branch off the first and second header pipes 191 and 192, the greater the pressure loss occurring in the refrigerant 16 circulating therethrough tends to be. This may hinder the refrigerant 16 that has flowed into the individual condenser pipes 17 from flowing uniformly therethrough, and thus eventually leads to lower heat exchange efficiency.

Figure 15:
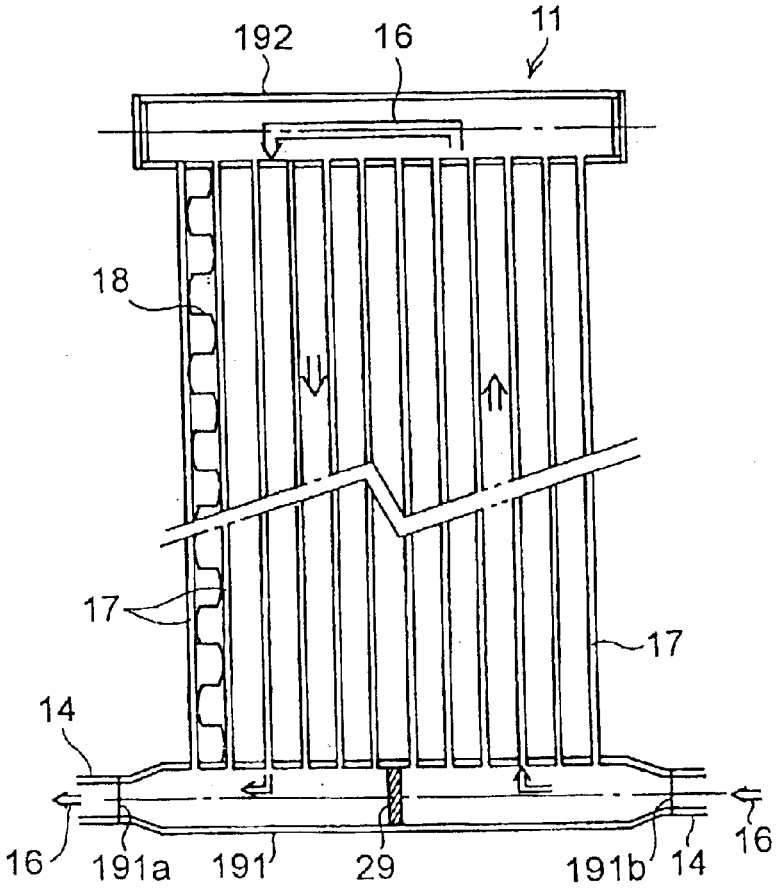
FIG. 15 is a sectional view schematically showing the construction of the heat-rejecting heat exchanger of the Stirling refrigerating system of a sixth embodiment of the invention.

A sixth embodiment of the invention will be described below with reference to the drawings. FIG. 15 is a schematic sectional view showing the configuration of the heat-rejecting heat exchanger of the Stirling refrigerating system of this embodiment. It is to be noted that FIG. 15 shows a two-dimensional section for easy understanding of the heat-rejecting heat exchanger 11 although, in reality, as shown in FIG. 2, it has a cylindrical shape with the first and second header pipes 191 and 192 arranged next to each other and parallel to the axis of the Stirling refrigerating device body 9.

The present embodiment will be described with reference to FIG. 15. At both ends of the first header pipe 191, there are provided connection ports 191*a* and 191*b* that are connected to the pipes 14. The second header pipe 192 is closed with no connection port provided at either end. The first and second header pipes 191 and 192 are connected together by 12 mutually parallel ring-shaped condenser pipes 17 so as to communicate with each other. At the center of the first header pipe 191 in its length direction, i.e., between the sixth and seventh condenser pipes 17, there is provided a partition plate 29 for separating the interior of the first header pipe 191 into a left-hand and a right-hand portion. This partition plate 29 is a disk made of aluminum, the same material as the first header pipe 191.

The procedure for producing this heat-rejecting heat exchanger 11 is basically the same as described earlier. At the center of the inner surface of the first header pipe 191, a groove is formed beforehand. Then, the partition plate 29 is inserted into the groove, and the first and second header pipes 191 and 192 are arranged on a plane, parallel to but away from each other. Then, the plurality of condenser pipes 17 are fitted into the first and second header pipes 191 and 192 in places thereon facing each other, and are held with a jig to maintain a predetermined shape. Then, the fins 18 are fitted between the condenser pipes 17 to produce a flat prototype of the heat-rejecting heat exchanger 11. Then, the heat-rejecting heat exchanger 11 is heated inside a blast furnace set at about 620° C. so that its components are welded together where they fit into or make contact with one another. Then, the heat-rejecting heat exchanger 11 is taken out of the blast furnace and cooled, and then the condenser pipes 17 are bent along the circumferential surface of a cylindrical jig so that the heat-rejecting heat exchanger 11 is formed into a ring-like shape with the first and second header pipes 191 and 192 placed next to each other. Then, the connection ports 191*a* and 191*b* are formed at both ends of the first header pipe 191. Lastly, the first and second header pipes 191 and 192 are fixed to each other with a spacer 20 (see FIG. 4B), made of a material with low thermal conductivity, interposed in between to complete the heat-rejecting heat exchanger 11, now cylindrical.

Next, the flow of the refrigerant will be described. When the circulation pump 15 is operated, the refrigerant 16 flows into the first header pipe 191 via the connection port 191*b*, and then moves toward the partition plate 29, filling the right-hand half of the first header pipe 191. The refrigerant 16 then flows uniformly through the right-hand six condenser pipes 17 into the second header pipe 192. The refrigerant 16 then moves leftward inside the second header pipe 192, and then flows uniformly through the left-hand six condenser pipes 17. The refrigerant 16 then flows through the first header pipe 191 and is then discharged via the connection port 191*a* into the pipe 14.

In this embodiment, there are provided 12 condenser pipes 17. However, in a case where the Stirling refrigerating device yields higher output, and therefore the heat-rejecting heat exchanger 11 needs to be provided with an increased number of condenser pipes 17, it is necessary to increase the number of partition plates 29 that separate the interior of the first header pipe 191 to permit the refrigerant 16 to flow back and forth an increased number of times so that the refrigerant 16 flows uniformly through the individual condenser pipes 17.

Figure 16:
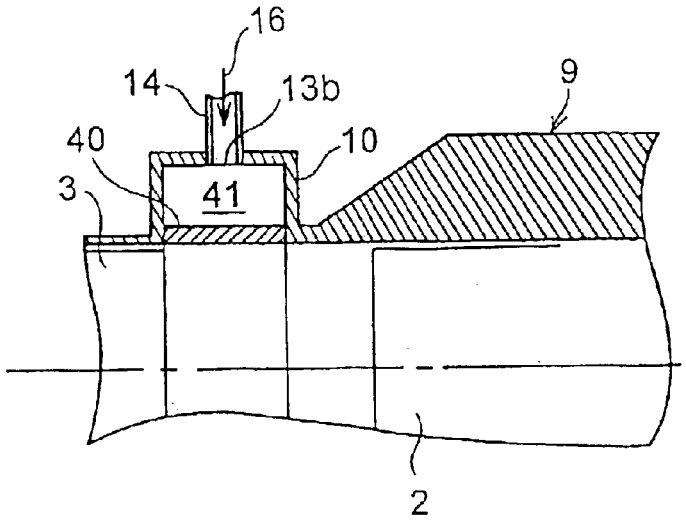
FIG. 16 is an enlarged sectional view of a portion of the Stirling refrigerating system of a seventh embodiment of the invention.

A seventh embodiment of the invention will be described below with reference to the drawings. FIG. 16 is an enlarged sectional view showing a portion of the Stirling refrigerating system of this embodiment. In the present embodiment as shown in FIG. 16, the warm section 10 is so formed as to have a C-shaped section so that a doughnut-shaped space 41 is formed inside, and that a ring-shaped internal heat exchanger 40 is provided so as to hermetically close the inner side of the doughnut-shaped space 41.

Next, the flow of the refrigerant will be described. When the circulation pump 15 (see FIG. 2) is operated, the refrigerant 16 flows into the doughnut-shaped space 41 via the first connection port 13*a*, then passes around the internal heat exchanger 40, and is then discharged via the second connection port 13*b*. This permits the compression heat of the working gas to be efficiently transferred to the refrigerant 16 through the internal heat exchanger 40.

Figure 17:
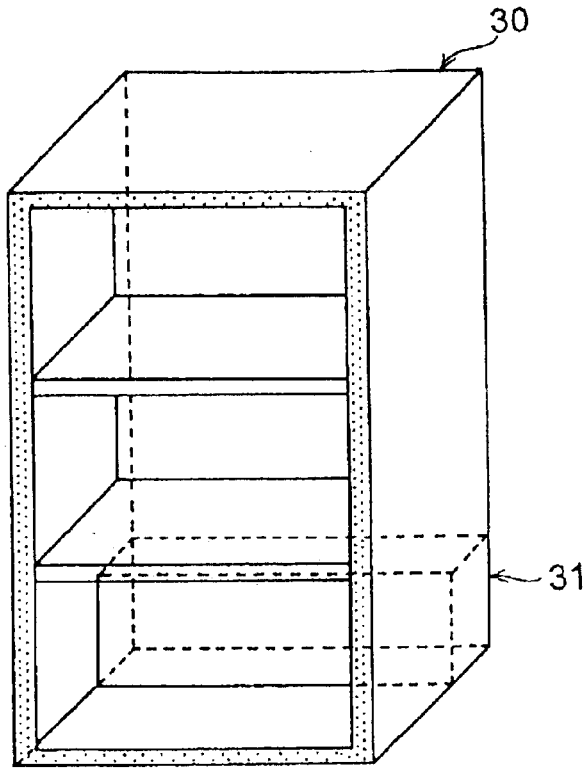
FIG. 17 is an external perspective view showing an outline of the construction of the refrigerator of an eighth embodiment of the invention.

An eighth embodiment of the invention will be described below with reference to the drawings. FIG. 17 is an external perspective view showing an outline of the construction of a refrigerator taken up as an example of a cooling apparatus incorporating a Stirling refrigerating system. The refrigerator has an interior thereof formed inside a body thereof by being enclosed with an insulating material, and the refrigerator interior is separated into a plurality of refrigerator compartments with partition plates.

Figure 18:
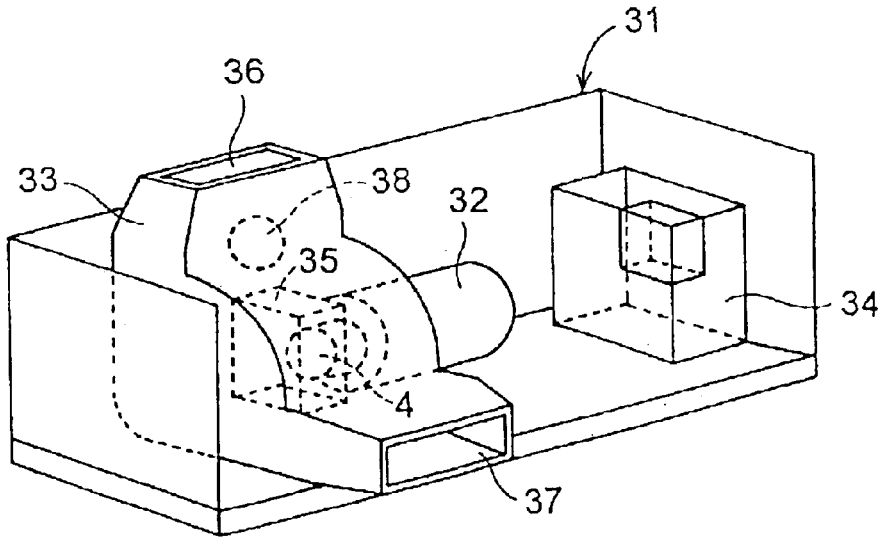
FIG. 18 is a perspective view of the machine compartment unit of the refrigerator.

In a lowest, deepest portion of the refrigerator body 30, a machine compartment unit 31 as shown in FIG. 18 is removably installed with screws or the like. Inside the machine compartment unit 31, there is housed a Stirling refrigerating system 32, which is a combination of a Stirling refrigerating device body 9 of one of the first to seventh embodiments described above, a heat-rejecting heat exchanger 11, and other components, and in addition there are also housed a cold air duct 33 that is connected via a cold air discharge opening 36 to a cold air passage (not shown) formed in a deepest portion inside the refrigerator body 30 so as to communicate therewith, and an electric box 34 that electrically controls the various components of the refrigerator.

The cold section 4 of the Stirling refrigerating system 32 is located inside the cold air duct 33, and the tip of the cold section 4 is kept in intimate contact with a side surface of a cooler 35 having the shape of a rectangular parallelepiped which is also disposed inside the cold air duct 33. Thus, the cold generated in the cold section 4 is transferred to the cooler 35 and stored therein.

Figure 19:
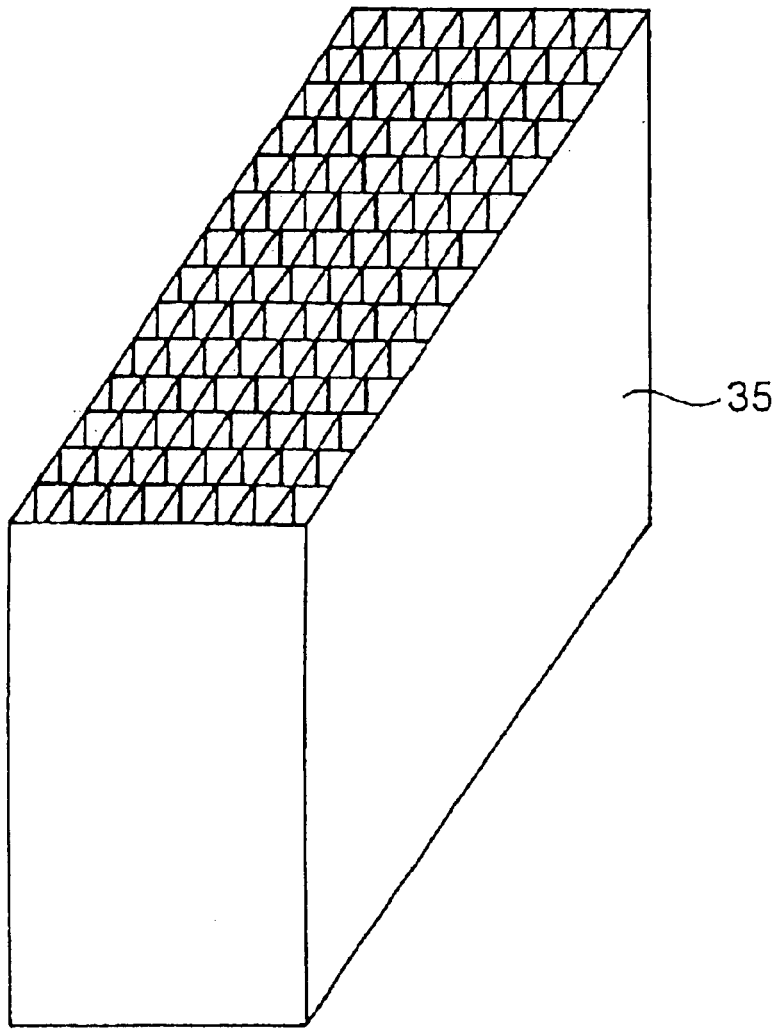
FIG. 19 is a perspective view of the cooler of the refrigerator.
Figure 20:
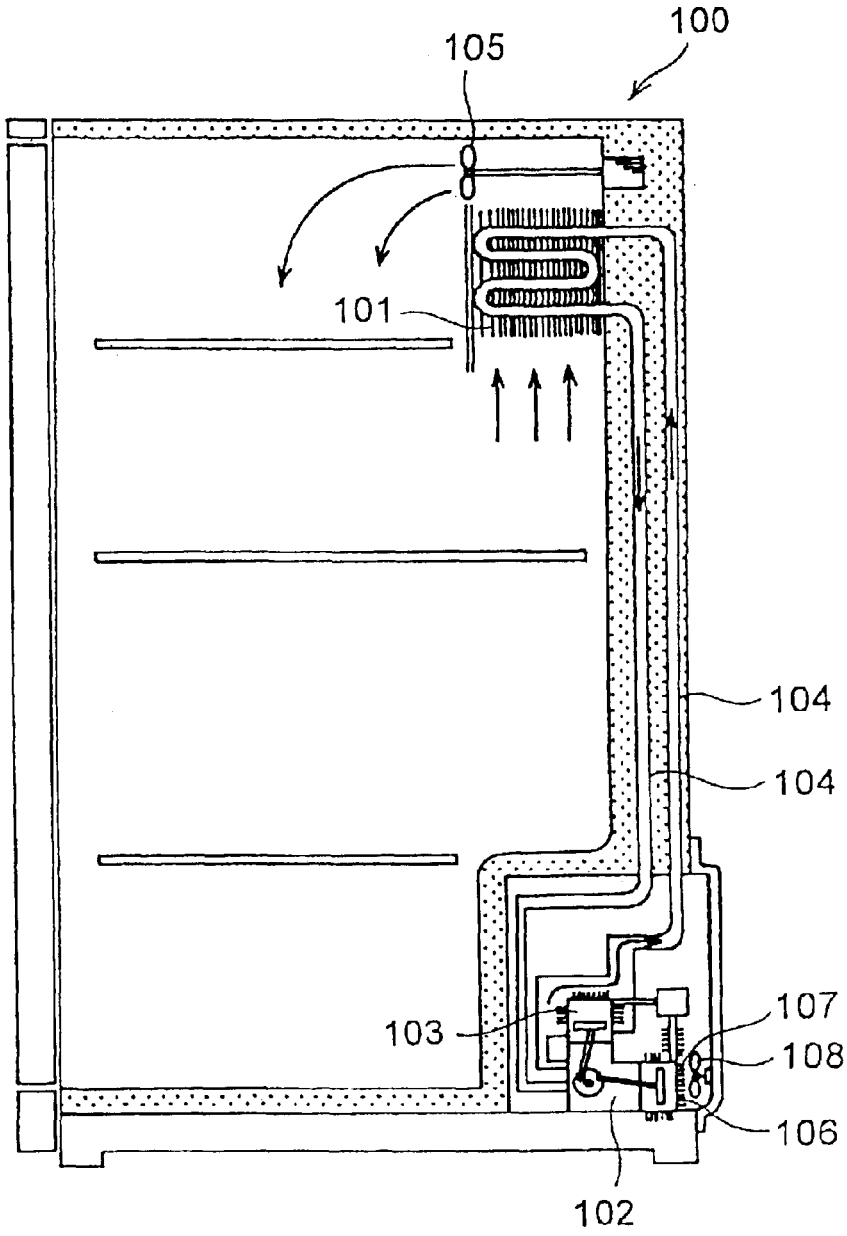
FIG. 20 is a side sectional view showing an outline of an example of the construction of a conventional Stirling refrigerator.

FIG. 19 shows the structure of the cooler 35. Inside a frame open at the top and the bottom and having substantially the shape of a rectangular parallelepiped, ribs are fitted to form a honeycomb structure. On the downstream side of the cooler 35 is arranged a blower fan 38, and, as the blower fan 38 rotates, air flows from the bottom to the top of the cooler 35 through the honeycomb structure inside the cooler 35 so that the cold stored in the cooler 35 is transferred from the surfaces of the ribs to the cold air.

The cold air is transferred, via the cold air discharge opening 36 of the cold air duct 33 and through the cold air passage, into the interior of the refrigerator body 30. The cold air circulates inside the refrigerator interior to cool it, and then returns, via a cool air return opening 37, to the upstream side of the cooler 35.

In this embodiment, the cold obtained from the Stirling refrigerating device is discharged, in the form of cold air, directly into the refrigerator interior to achieve cooling. However, it is also possible, as disclosed in Japanese Patent Application Laid-Open No. H7-180921, to perform heat exchange between a closed circuit through which cold air is circulated and the air inside the refrigerator by way of fins and blow the thus cooled air with a fan to achieve cooling. This embodiment deals with a refrigerator merely as one example of a cooling apparatus, and the Stirling refrigerating system described above may be removably installed in any other type of cooling apparatus, for example, compact coolers and freezers.

INDUSTRIAL APPLICABILITY

As described above, according to the present invention, a hollow ring-shaped member is provided in a heat rejecter to which compression heat is rejected as a Stirling refrigerating device is operated, and the ring-shaped member is connected, with a pipe, to a cylindrical heat-rejecting heat exchanger fitted around the body of the Stirling refrigerating device to form a closed circuit, through which a refrigerant is circulated. This makes it possible to produce a Stirling refrigerating system in which the heat generated in a heat rejecter is transferred by a refrigerant so as to be efficiently rejected to outside by a heat-rejecting heat exchanger. In this way, it is possible to realize a Stirling refrigerating system. This makes it possible to obtain the desired amount of cold stably from the heat absorber of the Stirling refrigerating device.

This Stirling refrigerating system can be installed in a space-saving manner inside a machine compartment formed at the bottom of the body of a cooling apparatus. Thus, by the use of the cold generated in the heat absorber as the Stirling refrigerating device is operated, it is possible to efficiently cool the interior of the body enclosed with an insulating material.

What is claimed is:

1. A Stirling refrigerating system, comprising:

a Stirling refrigerating device including a piston and a displacer that reciprocate with a predetermined phase difference kept therebetween inside a cylinder having a working medium sealed therein, a heat absorber that absorbs heat from outside of the device to produce cold as a result of the working medium being expanded in an expansion space formed inside the cylinder as the displacer reciprocates, and a heat rejecter that rejects, to the outside of the device, heat generated as a result of the working medium being compressed in a compression space formed inside the cylinder as the piston reciprocates;

a ring-shaped member fitted to the heat rejecter and having a refrigerant flow passage;

a cylindrical heat-rejecting heat exchanger adapted to radiate heat collected by the ring-shaped member, the cylindrical heat-rejecting heat exchanger being disposed around the Stirling refrigerating device with a gap secured in between and formed to have a refrigerant flow passage;

a refrigerant circulation passage formed by connecting the refrigerant flow passage of the ring-shaped member and the refrigerant flow passage of the heat-rejecting heat exchanger with a pipe; and circulating means for circulating a refrigerant through the refrigerant circulation passage.

2. A Stirling refrigerating system as claimed in claim 1, wherein the heat-rejecting heat exchanger includes a first header pipe having, at one end thereof, a connection port to which one end of the pipe is connected, a second header pipe laid next to the first header pipe and parallel, together with the first header pipe, to an axis of the Stirling refrigerating device and having, at one end thereof, a connection port to which another end of the pipe is connected, a plurality of ring-shaped condenser pipes that connect the first and second header pipes together so that the first and second header pipes communicate with each other therethrough, and fins fitted between the plurality of condenser pipes.

3. A Stirling refrigerating system as claimed in claim 2, wherein the condenser pipes and the fins have substantially equal lengths in radial directions of the Stirling refrigerating device.

4. A Stirling refrigerating system as claimed in claim 1, wherein the circulating means includes a cylindrical rod slide portion formed at an end of the Stirling refrigerating device opposite to the heat absorber, a rod slidable together with the piston along an inner surface of the rod slide portion, a first magnet fitted at a tip end of the rod, a box member fitted at a tip end of the rod slide portion and forming part of the refrigerant circulation passage, a resonant spring placed inside the box member and having the rod slide portion placed therethrough, a second magnet slidable along an outer surface of the rod slide portion by an action of the resonant spring, and a movable member fixed to the second spring and capable of reciprocating along the outer surface of the rod slide portion and along an inner surface of the box member, and the refrigerant that has flowed into the box member is discharged therefrom by a pumping action of reciprocating movement of the movable member.

5. A Stirling refrigerating system as claimed in claim 2, further comprising:

a blower fan that blows air through a space inside the heat-rejecting heat exchanger.

6. A Stirling refrigerating system as claimed in claim 5, wherein the fins protrude outward from an outer profile of the condenser pipes in radial directions of the Stirling refrigerating device.

7. A Stirling refrigerating system as claimed in claim 1, wherein the heat-rejecting heat exchanger includes a first header pipe having, at both ends thereof, connection ports connected to the pipe and having an internal space thereof partitioned off in a length direction thereof, a second header pipe laid next to the first header pipe and parallel, together with the first header pipe, to an axis of the Stirling refrigerating device, a plurality of ring-shaped condenser pipes that connect the first and second header pipes together such that the first and second header pipes communicate with each other therethrough, and fins fitted between the plurality of condenser pipes.

8. A Stirling refrigerating system, comprising:

a Stirling refrigerating device including a piston and a displacer that reciprocate with a predetermined phase difference kept therebetween inside a cylinder having a working medium sealed therein, a heat absorber that absorbs heat from outside of the device to produce cold as a result of the working medium being expanded in an expansion space formed inside the cylinder as the displacer reciprocates, and a heat rejecter formed as a ring-shaped refrigerant flow passage that rejects, to a refrigerant, heat generated as a result of the working medium being compressed in a compression space formed inside the cylinder as the piston reciprocates;

a heat-rejecting heat exchanger disposed around the Stirling refrigerating device with a gap secured in between and defining a refrigerant flow passage therein;

a refrigerant circulation passage formed by connecting the refrigerant flow passage of the heat rejecter and the refrigerant flow passage of the heat-rejecting heat exchanger with a pipe; and circulating means for circulating a refrigerant through the refrigerant circulation passage.

9. A cooling apparatus having a Stirling refrigerating system as claimed in one of claims 1 to 8 housed inside a machine compartment formed at a bottom of a body of the cooling apparatus, wherein an interior of the body is enclosed with a heat-insulating material and is cooled by exploiting cold generated in the heat absorber as the Stirling refrigerating device is operated.

10. A Stirling refrigerating system, comprising:

a Stirling refrigerating device including a heat absorber that absorbs heat from outside of the device to produce cold, and a heat rejecter that rejects generated heat;

a first refrigerant flow passage that collects heat at the heat rejecter;

a second refrigerant flow passage connected to the first refrigerant flow passage, the second refrigerant flow passage surrounding the Stirling refrigerating device and forming a heat exchanger that radiates heat from a refrigerant, the second refrigerant flow passage and the Stirling refrigerating device defining a gap therebetween; and circulating means for circulating the refrigerant inside the first and second refrigerant flow passages.

11. A Stirling refrigerating system as claimed in claim 10, wherein the second refrigerant flow passage includes a first header pipe, a second header pipe provided adjacent to the first header pipe, and a plurality of condenser pipes that connect the first and second header pipes together such that the first and second header pipes communicate with each other therethrough, the Stirling refrigerating system, further comprising:

fins provided between the condenser pipes.

* * * * *